US005249531A

United States Patent [19]

Taylor

[11] Patent Number: 5,249,531

[45] Date of Patent: Oct. 5, 1993

[54] RAILRAOD HOPPER CAR DOOR ACTUATING MECHANISM

[76] Inventor: Fred J. Taylor, 8204 N. Dilcrest Cir., Florence, Ky. 41042

[21] Appl. No.: 796,681

[22] Filed: Nov. 25, 1991

Related U.S. Application Data

[63] Continuation of Ser. No. 407,412, Sep. 14, 1989, abandoned.

[51] Int. Cl.[5] ..... B61D 7/00

[52] U.S. Cl. ..... 105/290; 105/240; 105/299; 105/286

[58] Field of Search ..... 105/240, 253, 290, 299, 105/286, 287, 288, 296, 298, 248

[56] References Cited

U.S. PATENT DOCUMENTS

| | | | |
|---|---|---|---|
| 3,173,381 | 3/1965 | Charles et al. | 105/240 |
| 3,187,684 | 6/1965 | Ortner | 105/248 |
| 3,408,956 | 11/1968 | Rebenok et al. | 105/240 |
| 3,483,830 | 12/1969 | McGrath | 105/296 |
| 3,611,947 | 10/1971 | Nagy | 105/253 |
| 3,815,514 | 6/1974 | Heap | 105/240 |
| 3,818,842 | 6/1974 | Heap | 105/240 |
| 4,601,244 | 7/1986 | Fischer | 105/299 |

*Primary Examiner*—Mark T. Le
*Attorney, Agent, or Firm*—Jerrold J. Litzinger

[57] ABSTRACT

An actuating system for operating the doors of a railroad hopper car. A plurality of levers for each hopper operate to rotate the doors of the hopper between an open and a closed position. The mechanism applies a tension force, rather than a compressive force, to push the doors closed. The mechanism also provides an over center latch to positively close each door. The mechanism may be used on either single or double hopper doors.

17 Claims, 17 Drawing Sheets

RAILRAOD HOPPER CAR DOOR ACTUATING MECHANISM

CROSS REFERENCE TO A RELATED APPLICATION

This application is a continuation of U.S. Pat. application Ser. No. 07/407,412, filed Sep. 14, 1898, now abandoned.

BACKGROUND OF THE INVENTION

1. Field of the Invention

The present invention relates generally to an apparatus for opening the rotating doors of a railway hopper car, and in particular, to a novel apparatus for either simultaneously or sequentially opening the rotating hopper car doors from a single power source.

2. Description of the Prior Art

A common type of railroad freight car in use today is the open top freight car of the type wherein the load is discharged through hoppers on the underside of the body. Such cars are generally referred to as covered hopper cars and are used to haul coal, phosphate, and other commodities.

After hopper cars are spotted over an unloading pit, the doors of the hoppers are opened, allowing the material within the hopper to be emptied into the pit. There are several methods available for opening and closing these U.S. Pat. No. 3,596,609, issued to Ortner et. al., describes a system for simultaneously opening rotating hopper doors using a longitudinally extending operating rod connected to actuating shafts extending transversely below the hopper car body Each door operating lever rotates an actuating shaft, which in turns actuates a linkage mechanism to open and close the doors.

U.S. Pat. No. 4,741,274, issued to Ferris et. al., also describes a system for operating dump doors on a railway hopper car The lever of this invention is comprised of a single plate body portion with thru pivotal connections, with the pivotal connections coplanar with the door operating struts in a substantially vertical plan passing through the vertical transverse centerline of the center sill of the car to eliminate unnecessary rotational movements of the mechanism.

Other prior art references which teach operating mechanisms for opening and closing hopper doors include: U.S. Pat. Nos. 3,187,684; 3,339,500; 3,815,514; 3,818,842; 3,872,796; 3,994,238; 4,222,334; 4,542,701; 4,601,244; 4,688,488; and 4,829,908.

There are several disadvantages to the hopper door operating mechanisms which are in use today. One problem is that the prior art mechanisms are designed such that each actuating mechanism is connected to doors from two separate hoppers. Thus, if the mechanism fails, it affects the operation of two hoppers.

Another disadvantage of the present day hopper door mechanisms is that, since the mechanisms are designed to operate doors from two adjacent hoppers, the mechanisms must push the doors closed, with compressive forces being delivered to the mechanisms. This design makes it necessary to periodically adjust the mechanism as the system wears. In addition, the compressive forces applied to the hopper doors in closing may cause buckling problems.

A further disadvantage of present day hopper cars is that current operating mechanisms limit the distance of the door motion, thus limiting the open area of the car bottom, slowing down the unloading process and causing additional costs and potential damage to the car in certain situations, such as longer periods of time in thaw sheds.

SUMMARY OF THE INVENTION

It is an object of the present invention to provide a mechanism for actuating the doors of a multiple hopper car which has independent control of the doors of each separate hopper.

It is also an object of the present invention to provide a door actuating mechanism which does not need periodic adjustment to allow for wear of the parts.

It is a further object of this invention to provide a door operating system for a hopper car in which the closing and lockup of the hopper doors are in tension, as opposed to compression type mechanisms.

It is still a further object of the present invention to provide a system which will provide a greater opening in the bottom of a hopper car than is now available in order to allow quicker and safer discharge of its contents.

It is still a further object of the present invention to provide a door operating system in which each door assembly has a positive over center locking mechanism.

It is still a further object of the present invention to provide a mechanism which can be retrofitted into existing hopper cars as well as incorporated into new construction.

These and other objects may be accomplished by use of a shifting mechanism mounted on the underside of the center sill of the hopper car which operates upon each pair of gates of a respective hopper to close the gates by the use of levers under tension forces pulling the gates closed.

DESCRIPTION OF THE PREFERRED EMBODIMENTS

Figure 1:
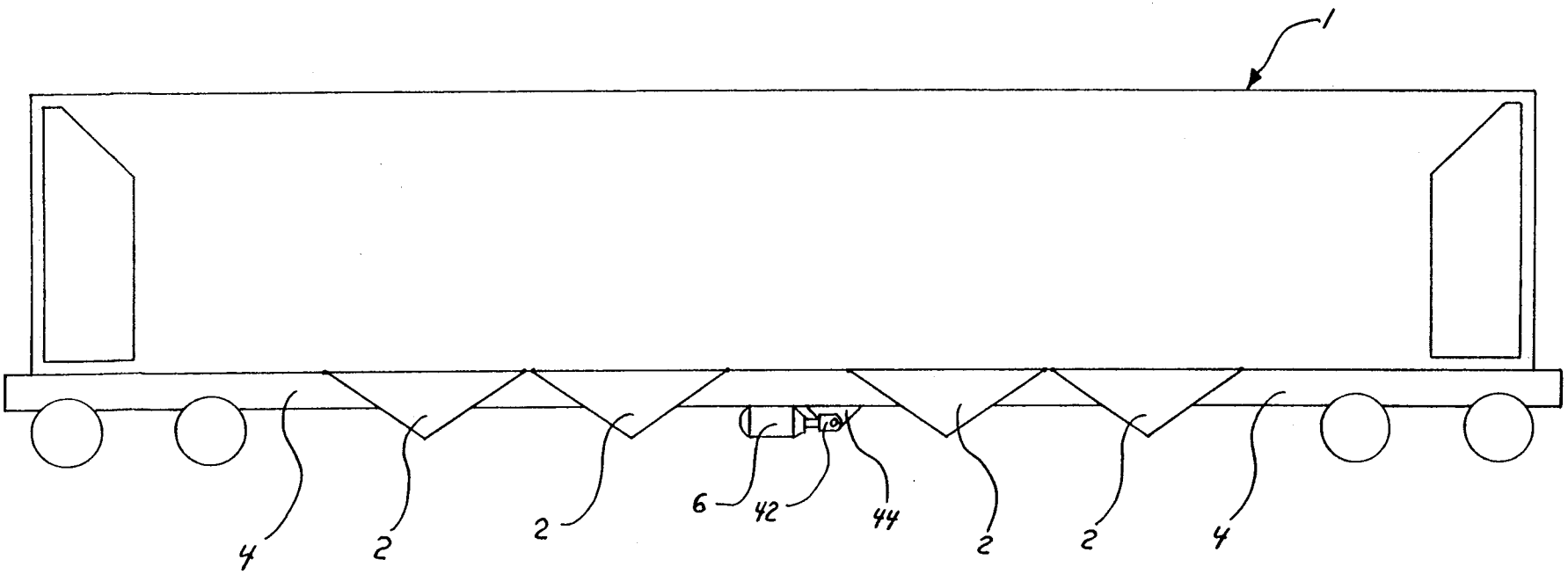
FIG. 1 is an elevational view of a standard four pocket hopper car incorporating the door actuating system of the present invention.

Referring now to FIG. 1, there is shown a typical four pocket railway hopper car, designated at 1, equipped with a preferred embodiment of the present invention. Car 1 is provided with a plurality of hopper units 2 and a longitudinally extending center frame member or sill 4. Each of hoppers 2 consist of two opposing door assemblies 5 having a pair of doors 5*a* and 5*b* on either side of center sill 4 (only one pair of doors is shown for each hopper in FIG. 1; there is a corresponding pair on the opposite side of sill 4). An air cylinder 6 is mounted to car 1 on the underside of sill 4 to provide power for the mechanism of the present invention. The operation of air cylinder 6 is well known in the art, and it is within the scope of the present invention to use any suitable power source (electric, liquid, steam) to operate cylinder 6.

Figure 2:
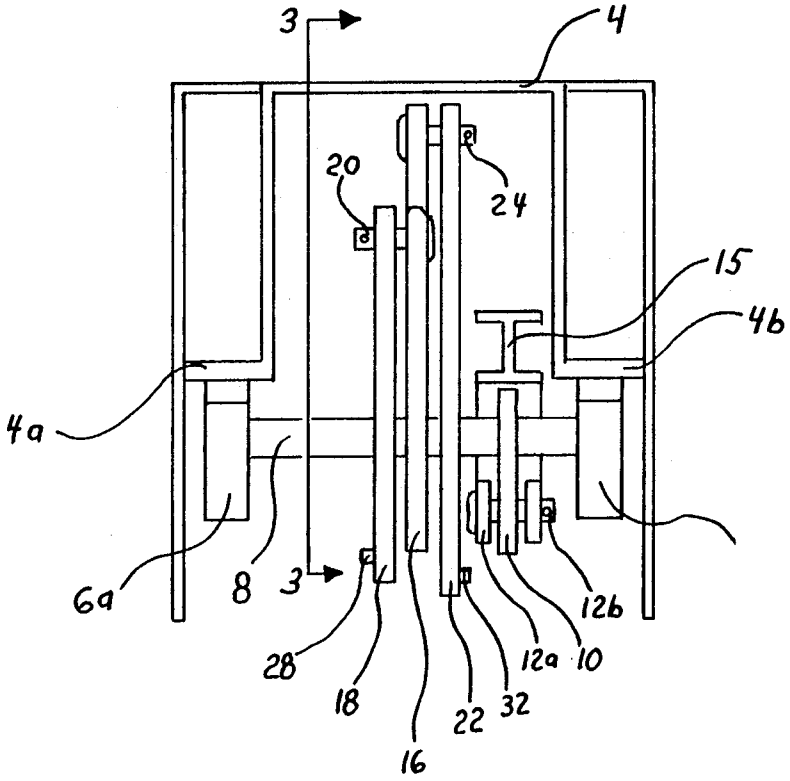
FIG. 2 is an end view, partly in cross-section, of the door actuating mechanism of the present invention in its closed position.
Figure 3:
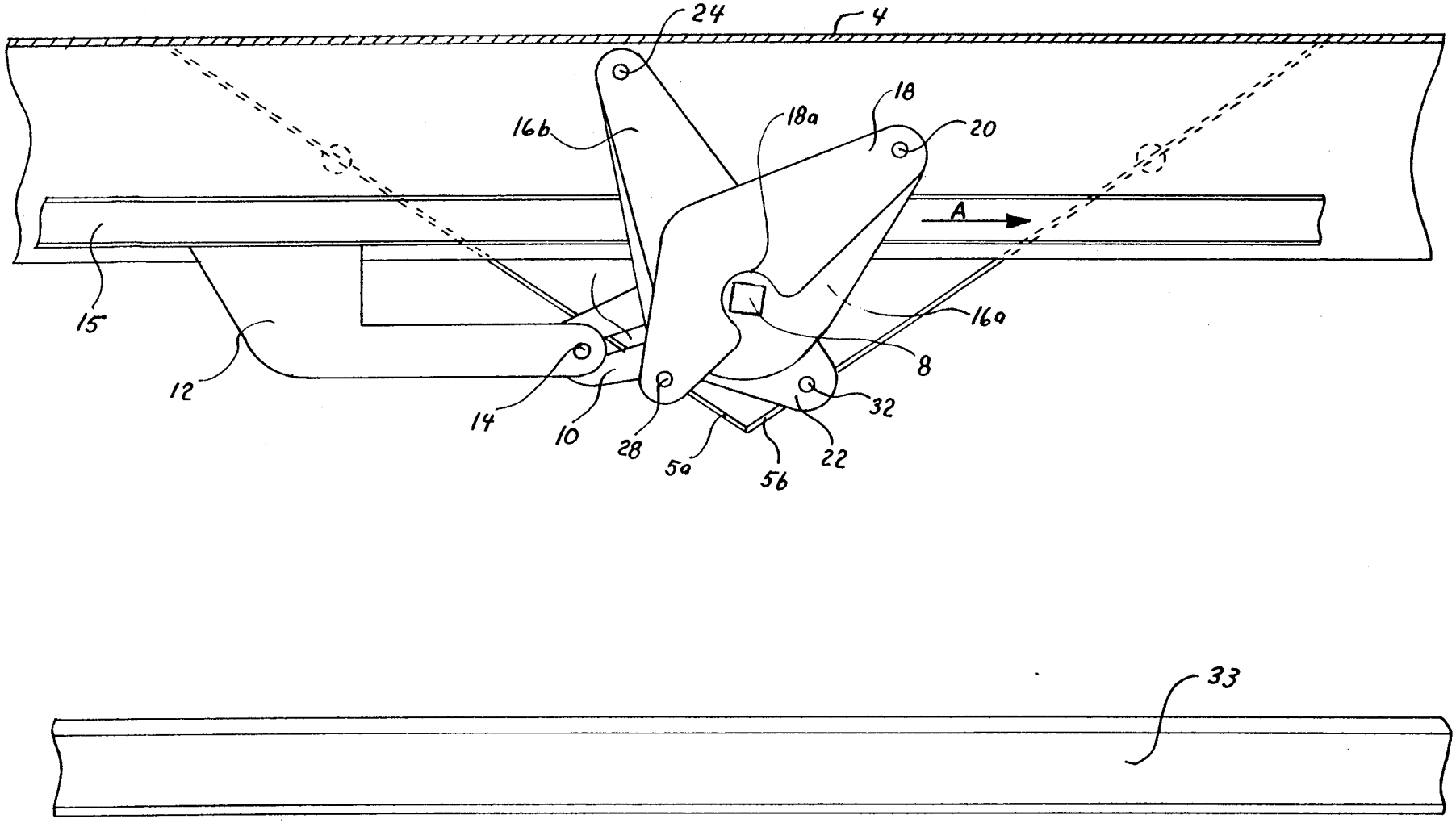
FIG. 3 is an elevational view, partly in cross-section, taken along section line 3—3 of FIG. 2.

The mechanism of the present invention is most clearly shown in FIGS. 2 and 3. Sill 4 is of inverted U-shaped cross-section with outwardly depending legs 4*a* and 4*b*. A pair of supports 6*a* and 6*b* are affixed to sill 4 at legs 4*a* and 4*b* respectively. Supports 6*a* and 6*b* are linked together by a square shaft 8 which is rotatably affixed between said supports.

A plurality of levers are affixed to shaft 8 to operate the door opening mechanism of the present invention. A connecting lever 10, affixed to shaft 8, is coupled to an actuating extension member 12 by a drive pin 14, which is slidably received within a slot 16 of lever 10, thus allowing lever 10 to rotate about shaft 8 as member 12 travels in a horizontal plane. Actuating extension member 12 may consist of two extending arms 12*a* and 12*b* between which lever 10 is received (FIG. 2). At its opposite end, extension member 12 is rigidly affixed to an actuating beam 15, which beam is coupled to air cylinder 6 to provide the operating force for the present invention, as will be described in greater detail hereinafter.

A V-shaped lever 16 is also affixed to shaft 8. One arm 16*a* of lever 16 is linked to a door opening lever 18 by connecting pin 20, while the other arm 16*b* is coupled to a door opening lever 22 by a connecting pin 24. Levers 18 and 22 each have a cutaway section 18*a* and 22*a* respectively in its central region to accommodate shaft 8 when the mechanism is in the closed position. The opposite end of opening lever 18 is affixed to a left hopper door 5*a* (FIG. 3) by a pin 28; the opposite end of opening lever 22 is affixed to a right hopper door 5*b* by a pin 32.

Figures 6, 7:
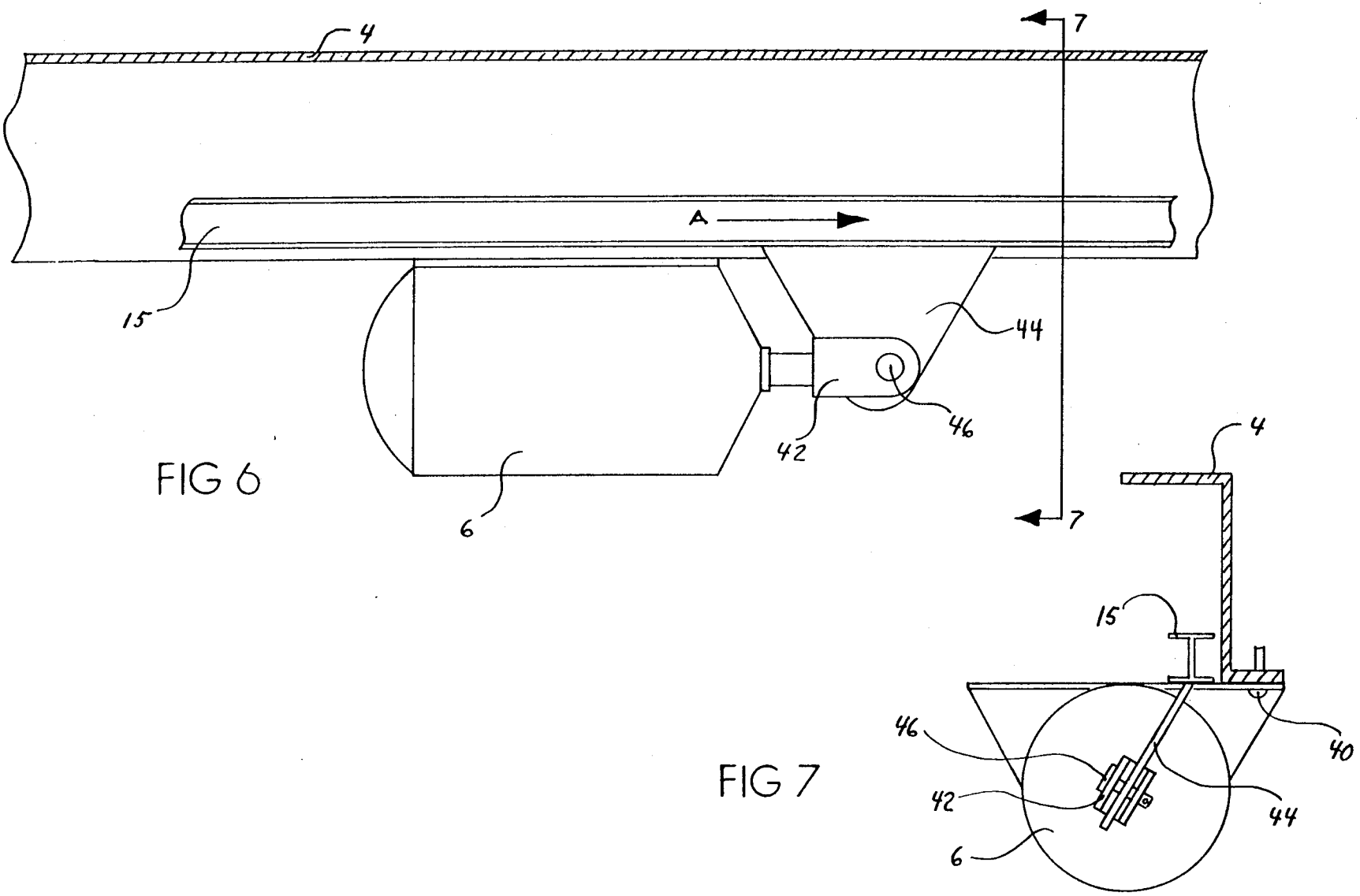
FIG. 6 is an elevational view, partly in cross-section, illustrating the activating means of the present invention.
FIG. 7 is a cross-sectional view taken along lines 7—7 of FIG. 6.

Referring now to FIGS. 6 and 7, air cylinder 6 and its operation will be described. Cylinder 6 is rigidly affixed to the underside of sill 4 at leg 4*b* by a series of rivets 40 (one of which is shown) or a similar mounting means. A clevis 42 is attached to the operating rod of cylinder 6, which clevis is coupled to a downwardly depending extension number 44 of actuating beam 15 via a pin 46. In operation, when air is applied to cylinder 6, its operating rod forces clevis 42, and consequently actuating beam 15, in the direction indicated by arrow A.

The operation of the door actuating mechanism of the present invention may be described as follows. As the mechanism is activated by applying air to cylinder 6 (FIG. 6), clevis 42 forces extension member 44 and actuating beam 15 to begin to move in the direction indicated by arrow A. This, in turn, causes actuating extension member 12 to shift in the direction of arrow A, causing drive pin 14 to move along in slot 16 of lever 1*a*. As pin 14 moves along in a straight line in slot 16, which is angled upwardly (FIG. 3), lever 10 rotates in a counterclockwise direction. Square shaft 8, upon which lever 10 is fixed, is thus forced to rotate in the same direction. Lever 16, which is affixed to shaft 8, also begin rotating about shaft 8.

Figure 4:
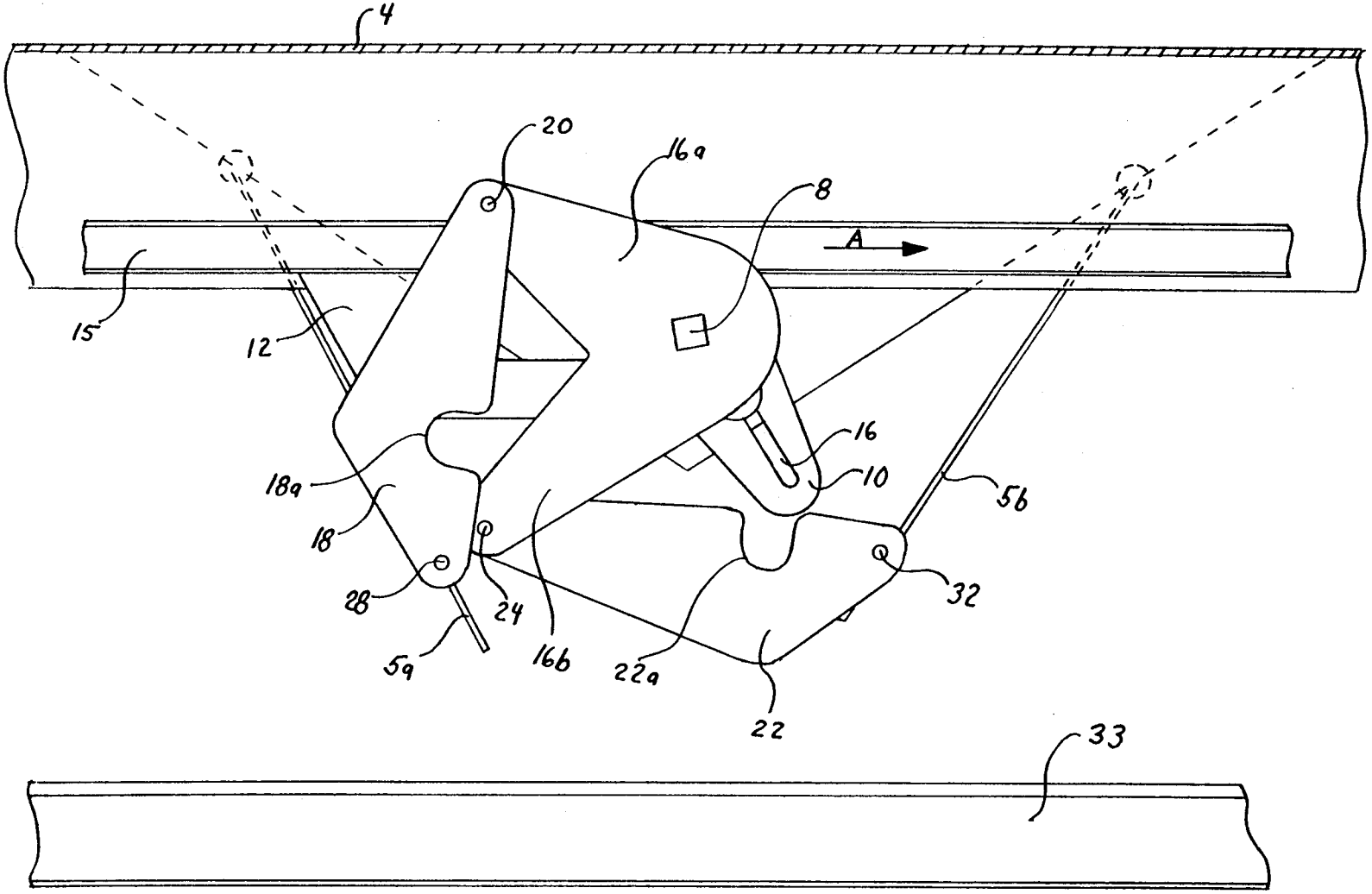
FIG. 4 is an elevational view, partly in cross-section, of the hopper doors and actuating mechanism as they are travelling from the closed to the open position.

Referring now to FIG. 4, the opening of the hopper doors has progressed. As extension member 12 continues its movement in direction A, lever 10 continues its counterclockwise rotation about shaft 8. The continued rotation of shaft 8 caused by lever 10 forces V-shaped lever 16 to continue to rotate. As arm 16*a* rotates about shaft 8, pin 20 moves in a counterclockwise direction about shaft 8. Door opening lever 18, which is coupled to arm 16*a* by pin 20, begins to rotate about pin 28 on left door 5*a* as extension member 12 begins its movement in direction A. As the center line between pins 20 and 28 passes through the center of shaft 8, the action of the over center latch is released, allowing the weight of door 5*a* (and also aided by the weight of contents of the hopper) to force pin 28 downwardly, causing lever 18 to begin to rotate in a clockwise direction.

As arm 16*b* rotates about shaft 8, pin 24 also moves in a counterclockwise direction about shaft 8. Door opening lever 22, which is coupled to 16*b* by pin 24, begins to rotate about pin 32 on right door 5*b*. As the center line between pins 24 and 32 passes through the center of shaft 8, the action of the over center latch is released, allowing the weight of door 5*b* (and the contents of the hopper) to force pin 32 downwardly, causing lever 22 to begin to rotate in a clockwise direction.

Figure 5:
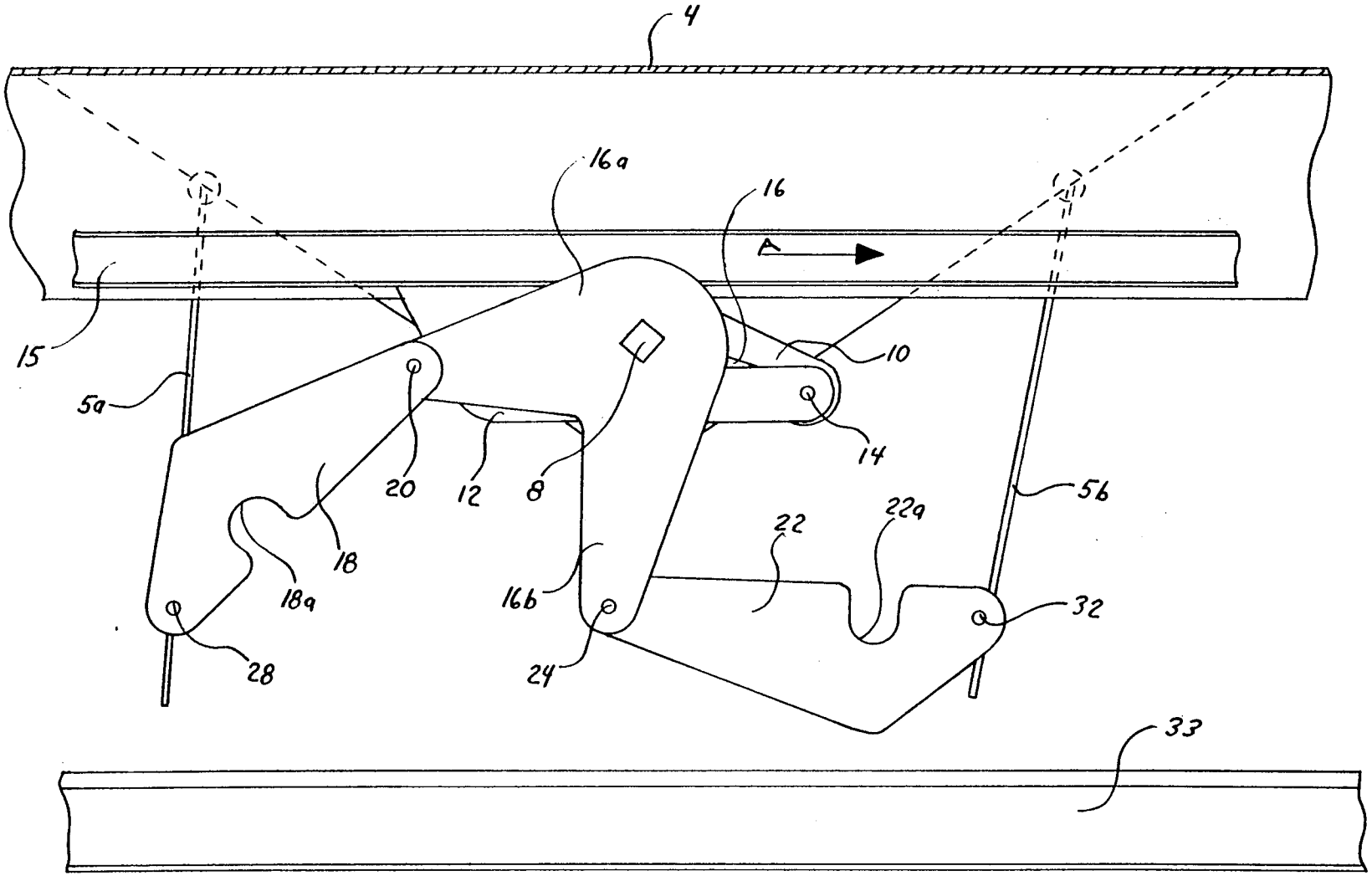
FIG. 5 is an elevational view, partly in cross-section, of the hopper doors and actuating mechanism of the present invention in their fully open position.

Referring now to FIG. 5, the door actuating mechanism of the present invention has completed its operation. The force of the contents of the hopper, along with the weight of doors 5*a* and 5*b*, has pushed doors 5*a* and 5*b* to their open position, in which the doors are almost perpendicular to the rail 33. This force has caused lever 16, through the action of levers 18 and 22, to rotate to its final open position in cooperation with the movement of actuating beam 15. It is important to note that in the fully open position, the open area at the bottom of the hopper is significantly larger than any presently known system, allowing the contents of the car to empty more quickly than any prior art hopper cars. In a train which contains many hopper cars, this can add up to a significant time and cost saving.

The closing of the doors of the hopper car is the reverse of the above. As can be seen, on the closing of the doors, the system creates a double over center latch for each pair of doors, adding a positive locking force for each hopper, adding to the safety of the system.

On a standard four pocket hopper car with eight hopper chutes, the largest unobstructed opening which can be obtained with the present door opening systems available is approximately 39 inches by 25 inches for each hopper chute. Therefore, the largest total unobstructed bottom area opening obtainable for these cars is approximately 54 square feet. By using the present invention, which has shorter doors than on the present cars, the opening can be doubled for each hopper chute, as the doors will open to the vertical position, as shown in FIG. 5. Thus, the total unobstructed bottom area opening which can be obtained using the present invention is over 108 square feet, twice the normal size. This allows the railroad cars to be emptied much quicker than is now possible, enabling an entire row of cars to be unloaded as they are in motion over the unloading pit.

Many other advantages of the present invention should now be apparent. The fact that the operating mechanism for each hopper is independent from the other hoppers (as compared to current systems in use where the mechanism operates two doors but on two adjacent hoppers) is important in that if one hopper chute is damaged, it can be disconnected by removing drive pin 14 from that particular hopper, and the remaining hoppers can still be safely operated. In addition, each independent door assembly has a double positive over center lock due to the fact that the doors of the present invention are pulled closed (a tension type mechanism), as opposed to the current systems which push the doors closed on adjacent hoppers (a compression type system). This also avoids any problem with doors buckling, which can frequently happen in compression type systems where the doors are pushed closed rather than pulled closed. The present system is designed so that directly prior to closing and snapping over center, the system is at its strongest point, whereas on the other systems available, they are at their weakest point just prior to closing, thus allowing small obstructions to possibly stop the doors from closing and locking properly. With the present invention being at its strongest point just prior to closing, small obstructions will not prevent the system from closing and locking properly.

Another significant advantage of the present invention is that once the mechanism is installed, there is never a need for periodic adjustments to allow for wear, as the independent hopper design and tension type closing action will always permit the system to operate and lock. In other current systems which operate doors of adjacent hopper using a compression type closing, as the components of the system wear, the mechanism must be readjusted to insure proper operation. This adjustment is time consuming and costly to the owner of the cars, especially when many cars are involved It is not uncommon for car owners to require annual adjustments.

Figure 8:
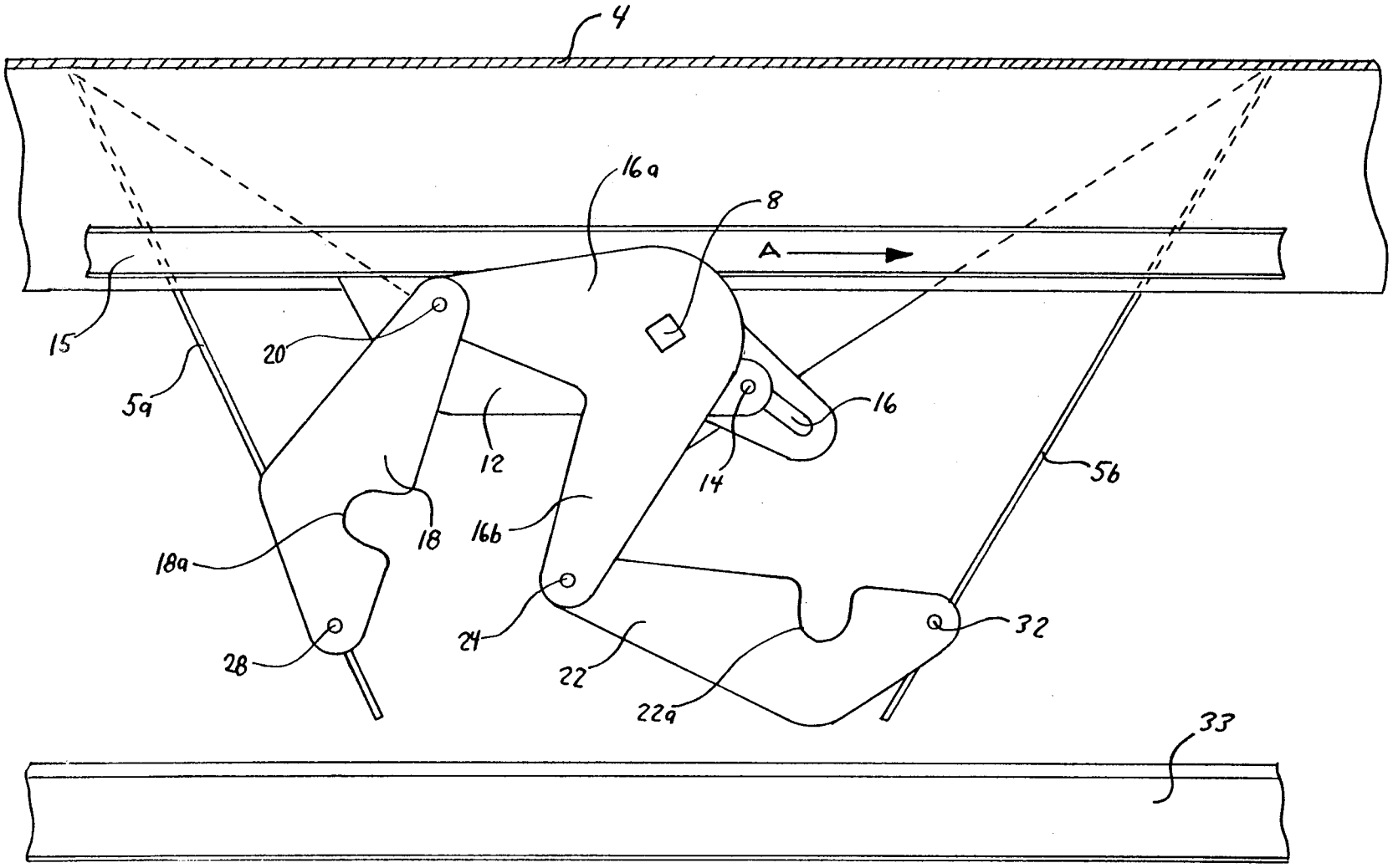
FIG. 8 is an elevational view, partly in cross-section, of a second embodiment of the present invention installed on a hopper car with standard size doors.

Other obvious advantages are the interchangeability of parts from hopper to hopper, and the protection from damage in the event of derailment, as the mechanism is located between the inside hopper sheets The embodiment of the invention described above is incorporated into a hopper car design which uses shorter doors than may be found in existing hopper cars. Although these short doors can be used on existing cars, the system of the present invention may be retrofitted onto existing hopper cars using the standard doors and hopper pockets. FIG. 8 shows a second embodiment of the present invention mounted on an existing railroad hopper car. Note that similar parts have similar reference numbers as in the first embodiment. The operation of the mechanism is exactly the same as that of the previous embodiment. The only difference is that the doors will only open as far as they would on the present hopper car, as shown in FIG. 8, thus allowing only the standard 54 square feet of unobstructed door opening area. However, the other advantages of the present invention, such as the over center latching, the tension force door closing, the independent control of each separate hopper, and the lack of needed periodic linkage adjustment are gained by the retrofitting of current railroad hopper cars with this novel mechanism.

Using the concept previously described in FIGS. 1–7, since the hopper doors are smaller than those found on the standard four pocket hopper car, a new car containing six pockets consisting of two opposing door assemblies can be constructed which further increases the amount of unobstructed door opening area for even quicker unloading of a bottom dump railcar. This car can be seen in FIGS. 9 and 10.

Figure 9:
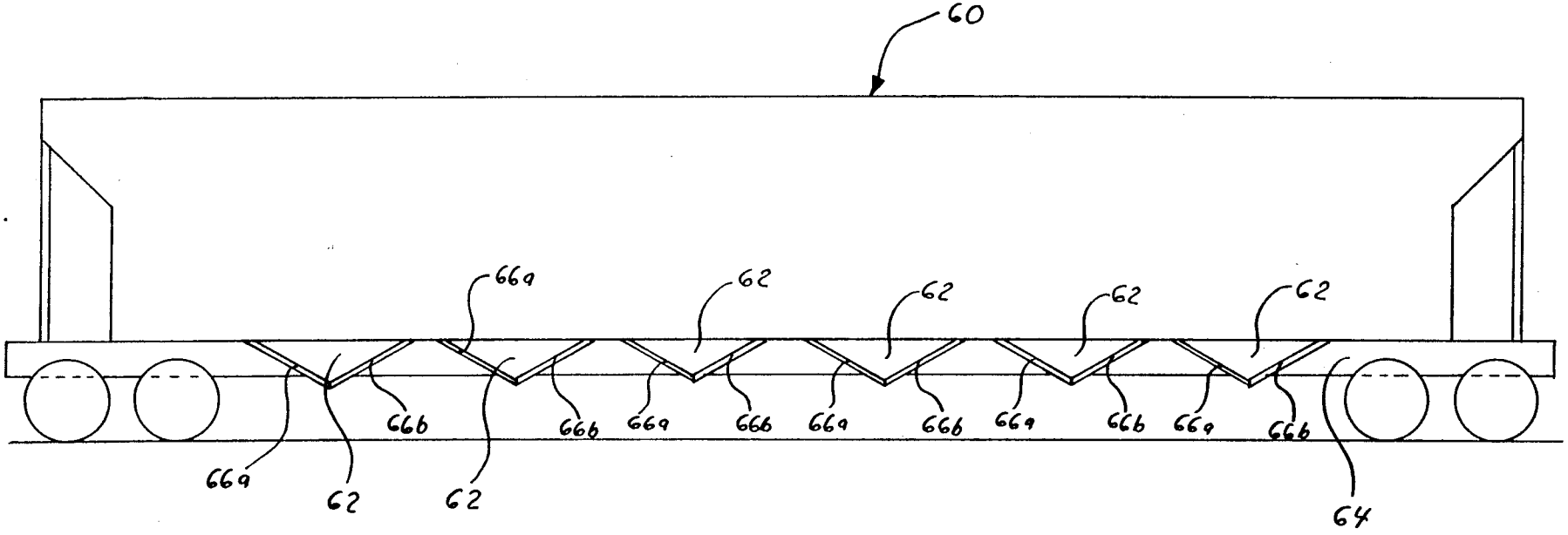
FIG. 9 is an elevational view of a six pocket hopper car incorporating the door actuating system of the present invention.

Referring now to FIG. 9, there is shown a six pocket hopper car generally designated as 60. Car 60 contains a series of six hoppers 62 and a longitudinally extending center sill 64. Each of hoppers 62 consist of two opposing door assemblies 66 having a pair of doors **66*a* and 66*b* on either side of center sill 64 (only one pair of doors 66 is shown for each hopper in FIG. 9; there is a corresponding pair on the opposite side of sill 64). Using the mechanism shown in detail in FIGS. 1–7, all of doors 66 can be opened simultaneously to the position shown in FIG. 10, where all of doors 66 are substantially perpendicular to the rail 68**.

Figure 10:
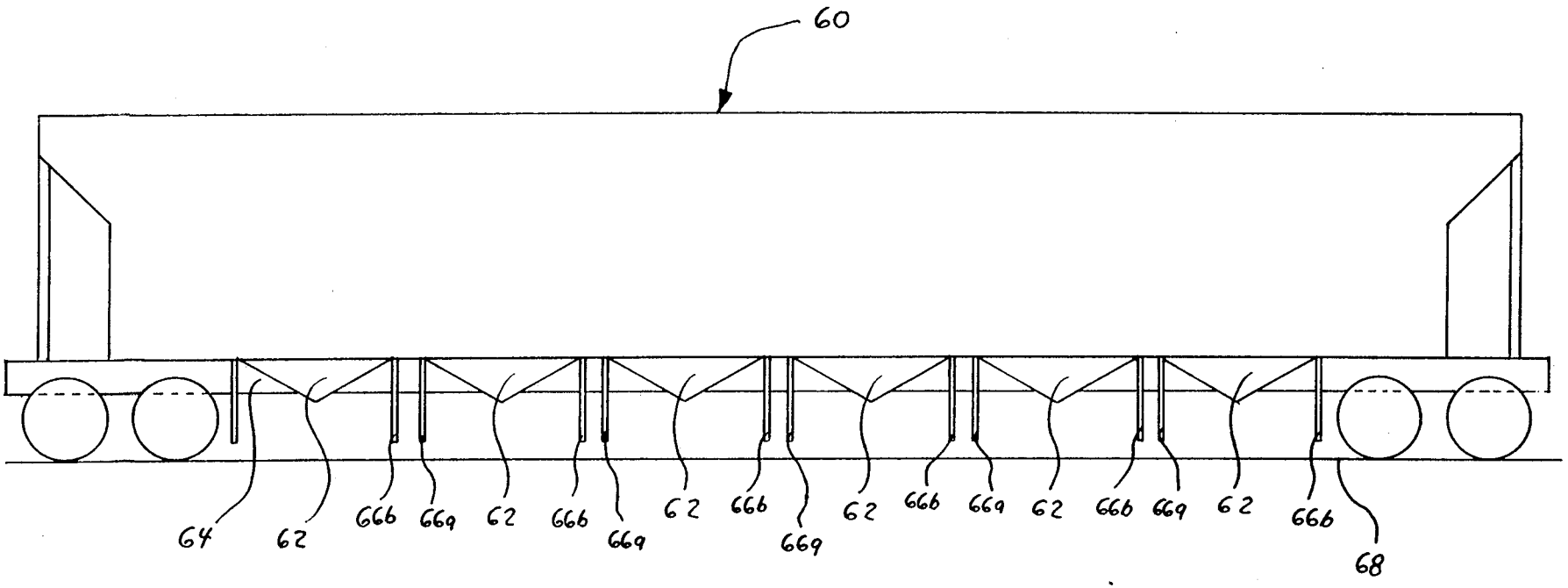
FIG. 10 is an elevational view of the hopper car of FIG. 9 with its doors in the open position.

By using the car of the embodiment shown in FIGS. 9 and 10, which contains 12 door openings measuring 43 $\frac{5}{8}$ inches by 50 inches, the total unobstructed door opening area obtainable using car 60 is 181.76 square feet, which is over three times the open area of the conventional hopper car in use today, greatly reducing the time necessary to empty the car of its contents. Thus, the car can move at a much faster pace than the current railcars when unloading in motion.

Figure 11:
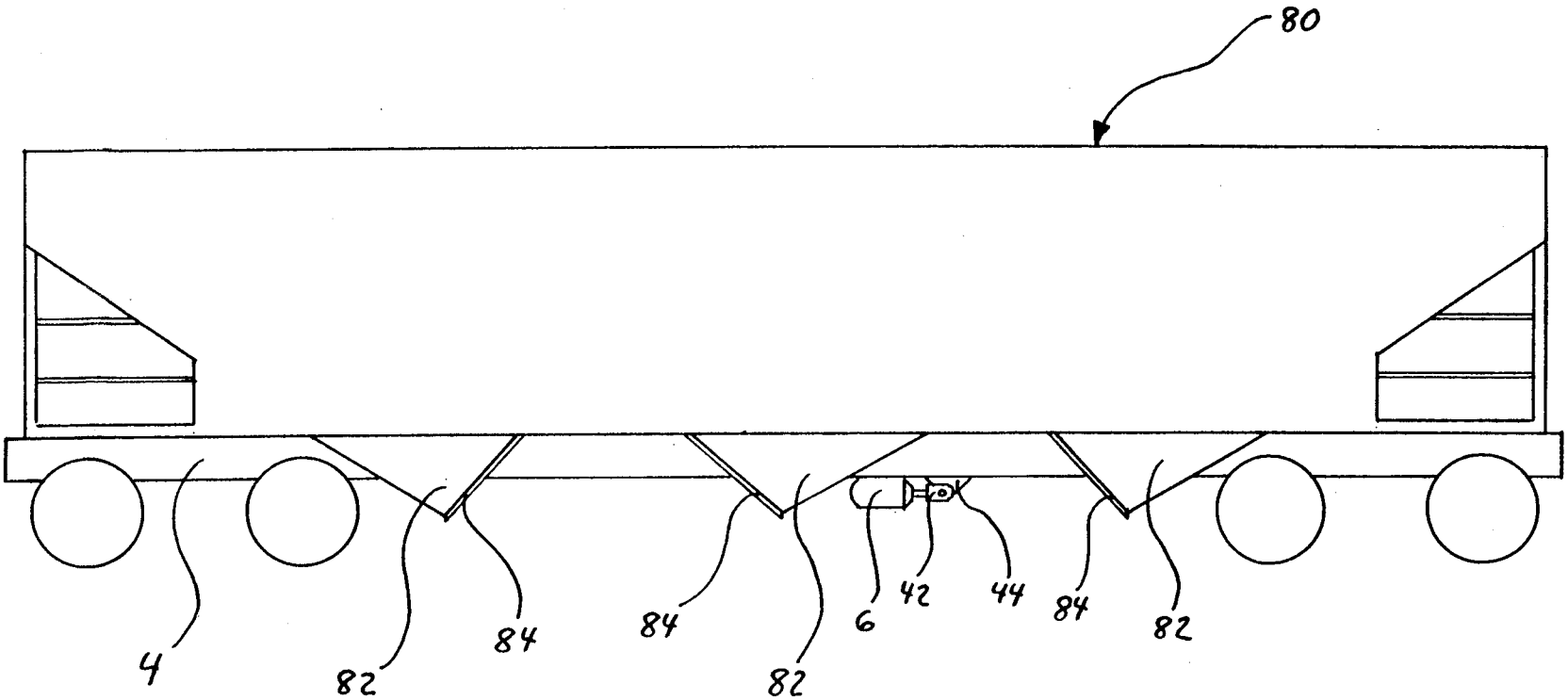
FIG. 11 is an elevational view of a three pocket hopper car incorporating a third embodiment of the door actuating system of the present invention.
Figure 12:
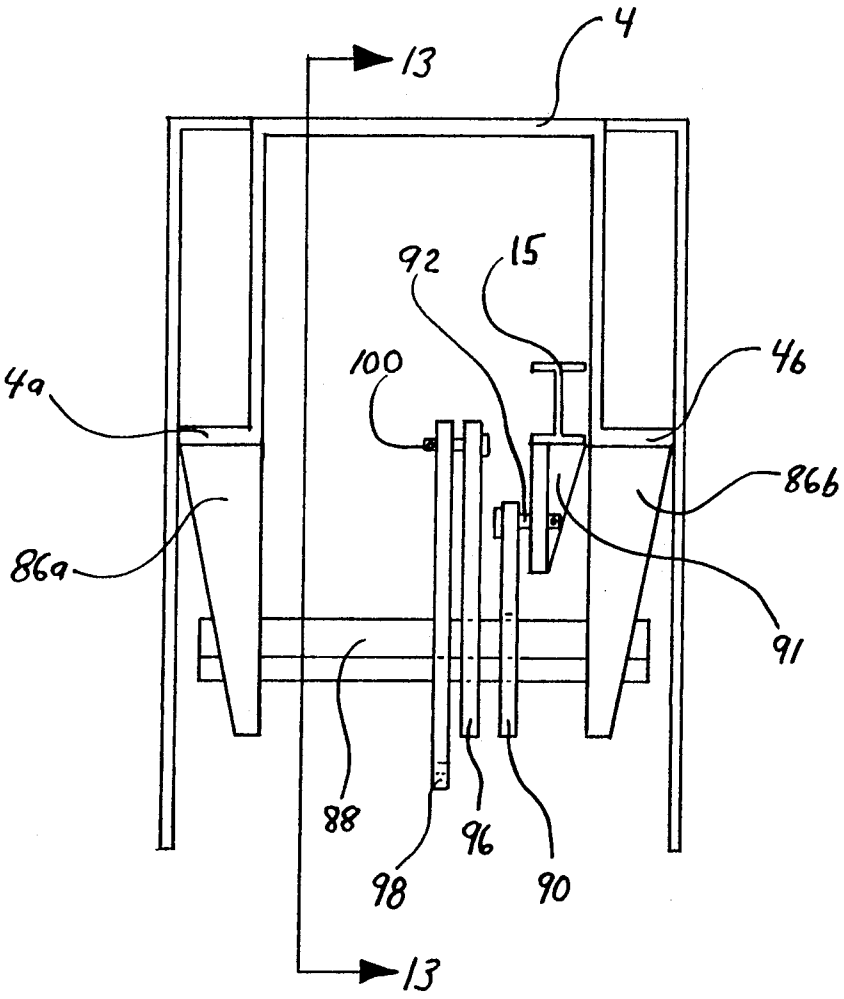
FIG. 12 is an end view, partly in cross-section, of one pocket incorporating the door actuating system on the hopper car shown in FIG. 11 in its closed position.
Figure 13:
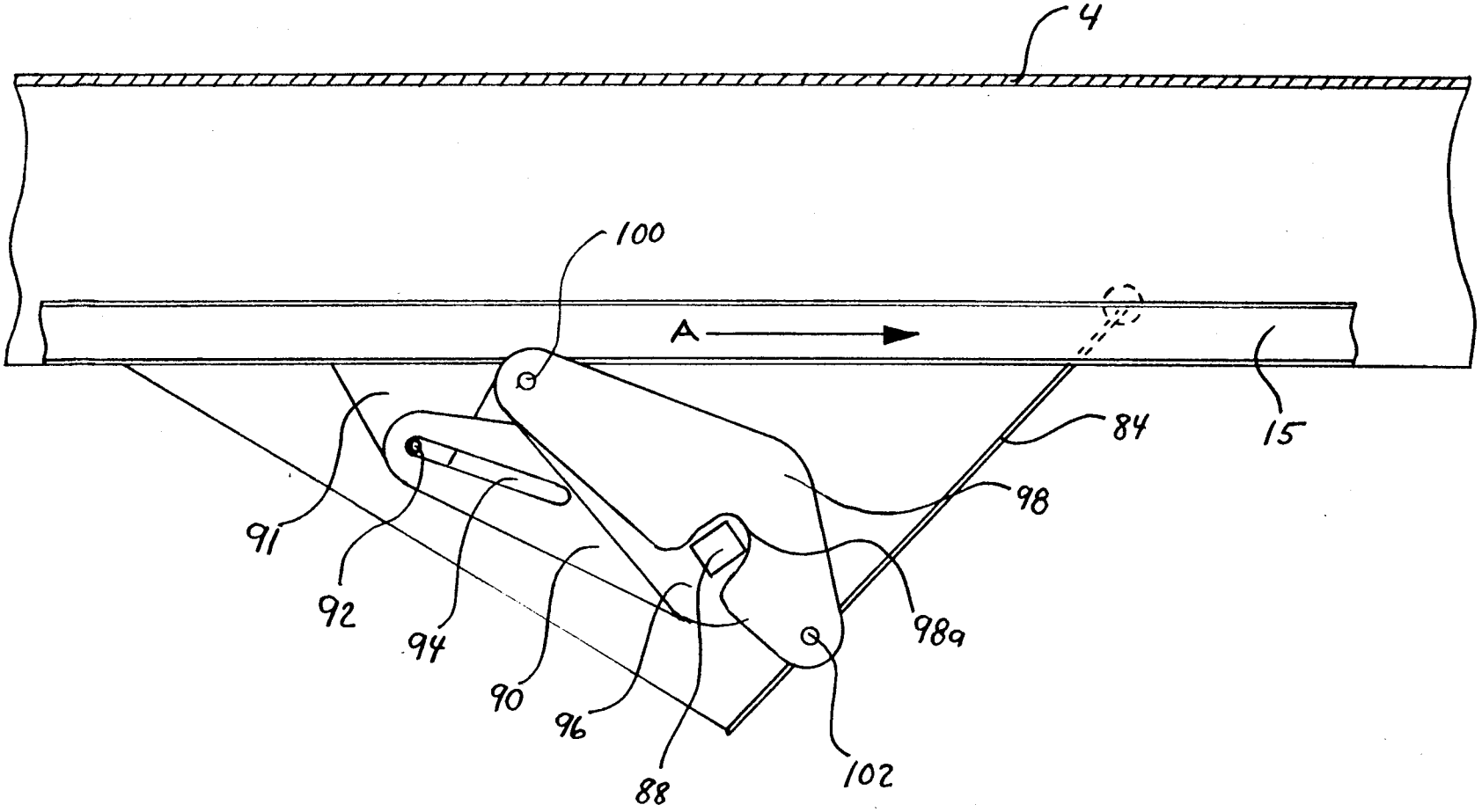
FIG. 13 is an elevational view, partly in cross-section, of the pocket of FIG. 12 taken along section line 13—13.

This same concept can also be applied to single door hoppers, which are usually found on automatic coal cars using 70 ton hoppers. FIGS. 11–19 show the use of the present invention on a single door three pocket hopper car. Referring now to FIG. 11, there is shown a three pocket hopper car generally designated at 80. Car 80 contains a series of hoppers 82 and a longitudinally extending center sill 4. Each of hoppers 82 has a pair of doors 84 associated therewith; only one of each pairs 84 is shown in these figures, as the corresponding door is located on the opposite side of sill 4.

Figures 18, 19:
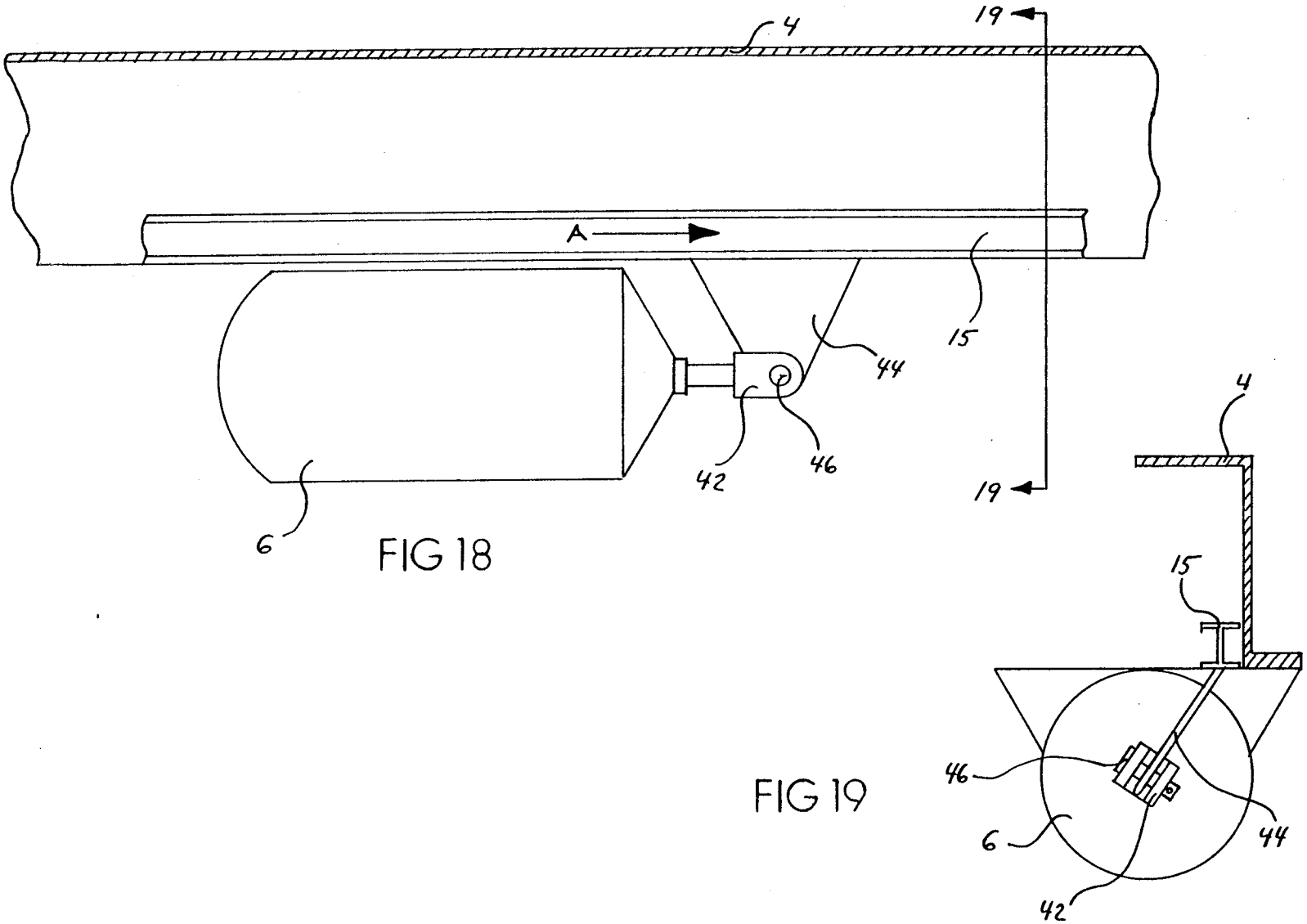
FIG. 18 is an elevational view, partly in cross-section, illustrating the activating means of the third embodiment
FIG. 19 is a cross-sectional view taken along lines 19—19 of FIG. 18.

An air cylinder 6 is mounted to car 80 on the underside of sill 84 to provide power to operate the mechanism of the present invention. The operation of air cylinder, shown in detail in FIGS. 18 and 19, is identical to that previously described in connection with FIGS. 6 and 7.

FIGS. 12-15 show the mechanism of the present invention in the closed position. Sill 4 is of inverted U-shaped cross section with outwardly depending legs 4*a* and 4*b*. A pair of supports 86*a* and 86*b* are affixed to sill 4 at legs 4*a* and 4*b* respectively. Supports 86*a* and 86*b* are linked together by a square shaft 88 which is rotatably affixed within supports 86*a* and 86*b* by conventional means, such as a bearing.

A plurality of levers are rigidly affixed upon shaft 88 to operate the door opening mechanism shown in this embodiment. A connecting lever 90, affixed to shaft 88 is coupled to an actuating extension member 91 of an actuating beam 15 by a drive pin 92, which is slidably received within a slot 94 of lever 90, thus allowing lever 90 to rotate about shaft 88 as member 91 travels in a horizontal plane. Also fixed on shaft 88 is an intermediate lever 96. The opposite end of lever 96 is pivotally connected to a door opening lever 98 by a pin 100. Lever 98, which has a cutaway section 98*a* to accommodate shaft 88 when the mechanism is in the closed position, is attached at its opposite end to door 84 by a pin 102.

Figure 14:
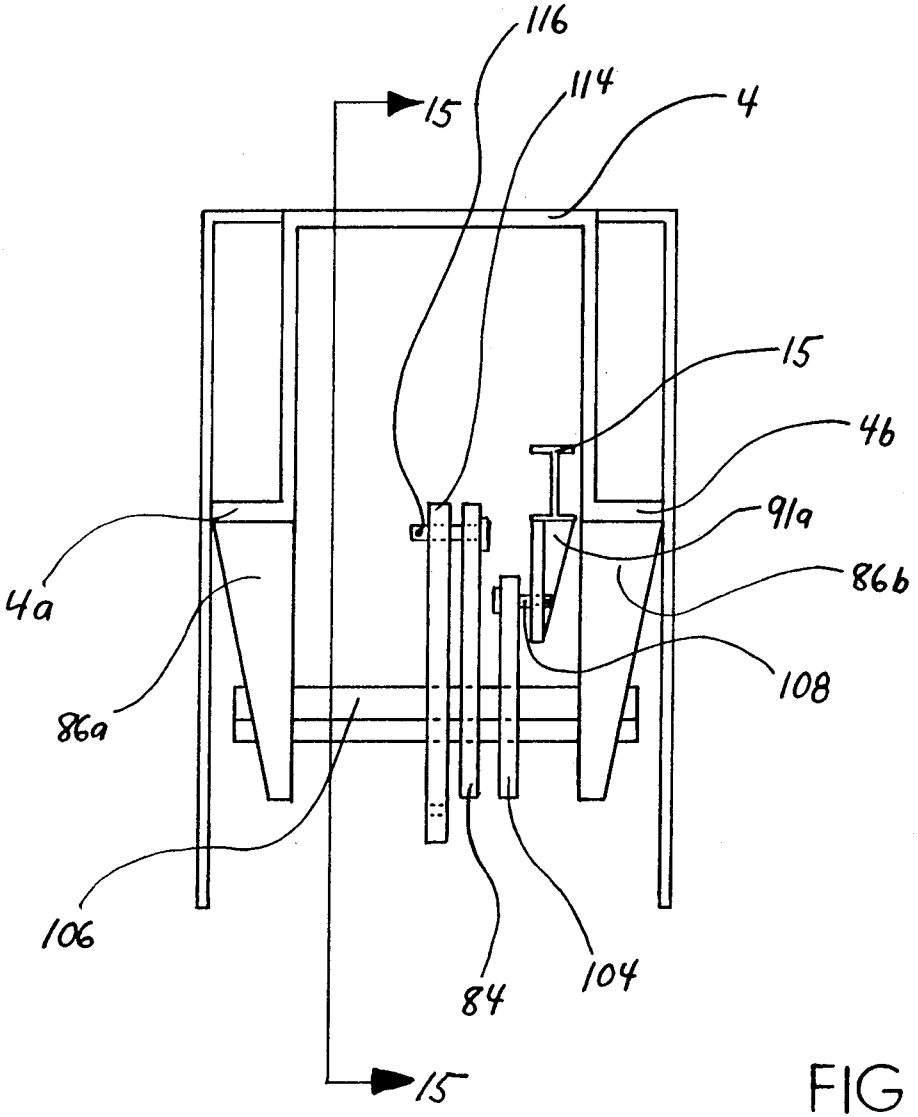
FIG. 14 is an end view, partly in cross-section, of a reverse pocket incorporating the door actuating system on the hopper car shown in FIG. 11 in its closed position.
Figure 15:
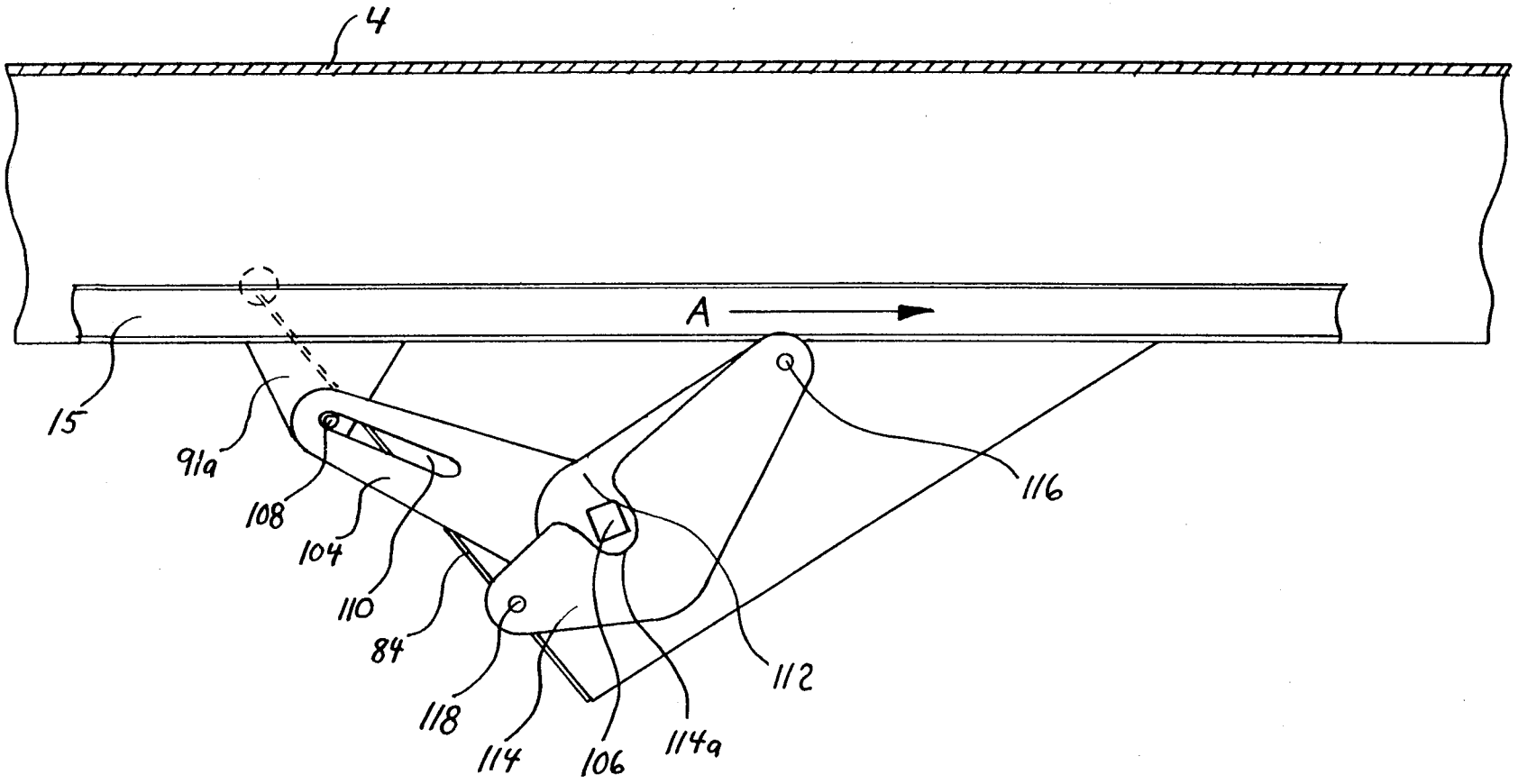
FIG. 15 is an elevational view, partly in cross-section, of the pocket of FIG. 14 taken along section line 15—15.

Referring now to FIGS. 14 and 15, a connecting lever 104, which is rigidly affixed to a shaft 106, is coupled to another actuating extension member 91*a* of beam 15 by a drive pin 108, which is slidably received within a slot 110 of lever 104, thus allowing lever 104 to rotate about shaft 106 as member 91*a* travels in a horizontal plane. Also, fixed on shaft 106 is an intermediate lever 112, the opposite end of which is pivotally connected to a door opening lever 114 by a pin 116. Lever 114, which has a cutaway section 114*a* to accommodate shaft 106 when the mechanism is in the closed position, is attached at its opposite end to door 84 by a pin 118.

The operation of its door actuating mechanism of this embodiment may be described as follows. As the mechanism is activated by applying air to cylinder 6 (FIG. 18), clevis 42 forces extension member 44 and actuating beam 15 to begin to move in the direction indicated by arrow A. This, in turn, causes actuating extension member 91 to travel in the direction of arrow A, causing drive pin 92 to move along within slot 94 of lever 90. As pin 92 moves along in a straight line in slot 94, lever 90 is forced to rotate in a clockwise direction. Shaft 88, upon which lever 90 is affixed, is thus forced to rotate in the same direction. Lever 96, also affixed to shaft 88, also begins to rotate about shaft 88. As extension member 91 continues its movement in direction A, levers 90 and 96 continue to rotate, also causing pin 100 to move in a clockwise direction. Door opening lever 98, which is coupled to lever 96 by pin 100, begins to rotate about pin 102 on door 84.

As the center line between pins 100 and 102 passes through the center of shaft 88, the action of the over center latch is released, allowing the weight of door 84 (and the hopper contents) to force lever 98 outwardly, thus opening the hopper.

Figure 16:
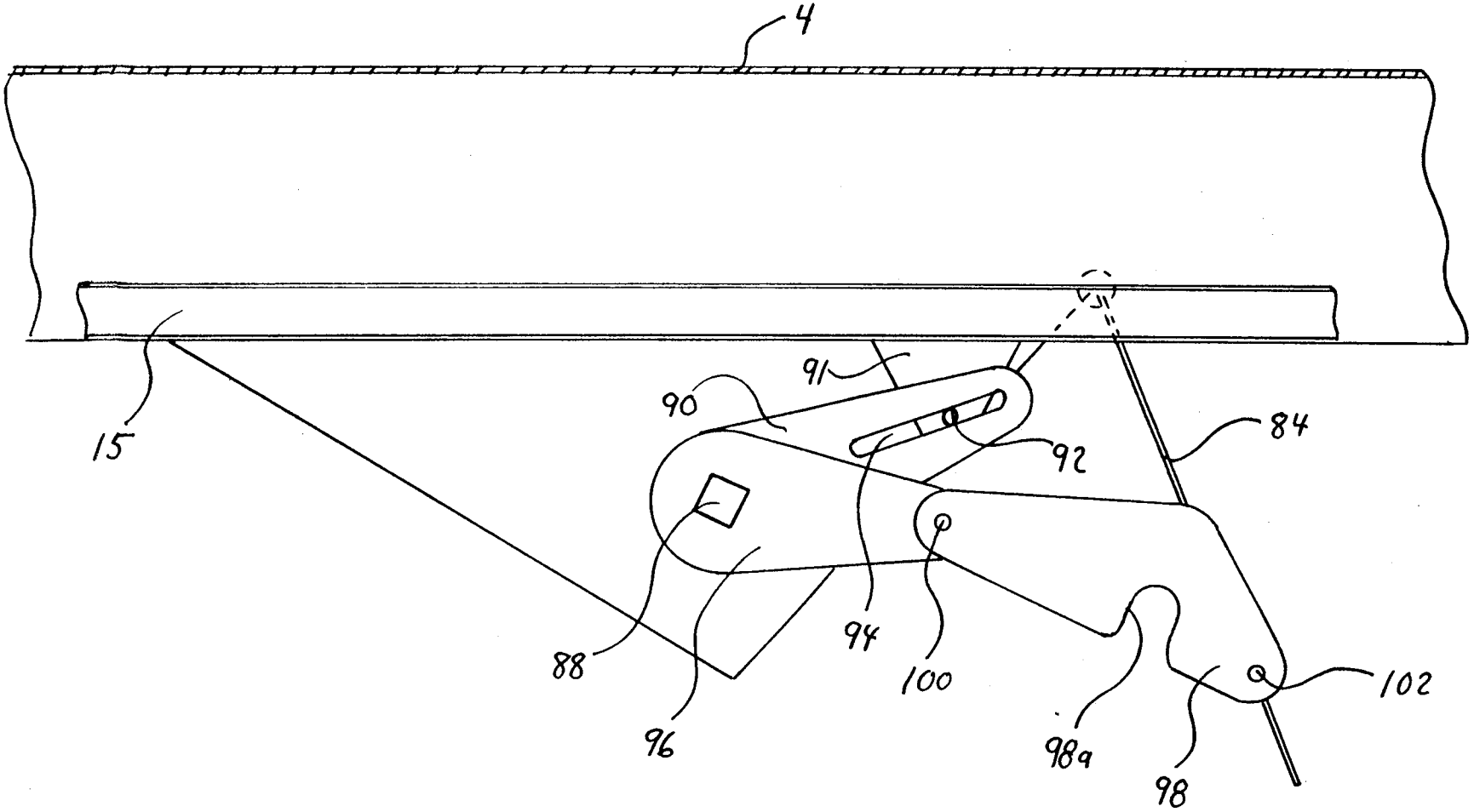
FIG. 16 is an elevational view, partly in cross-section, of the pocket shown in FIG. 13 in its open position.
Figure 17:
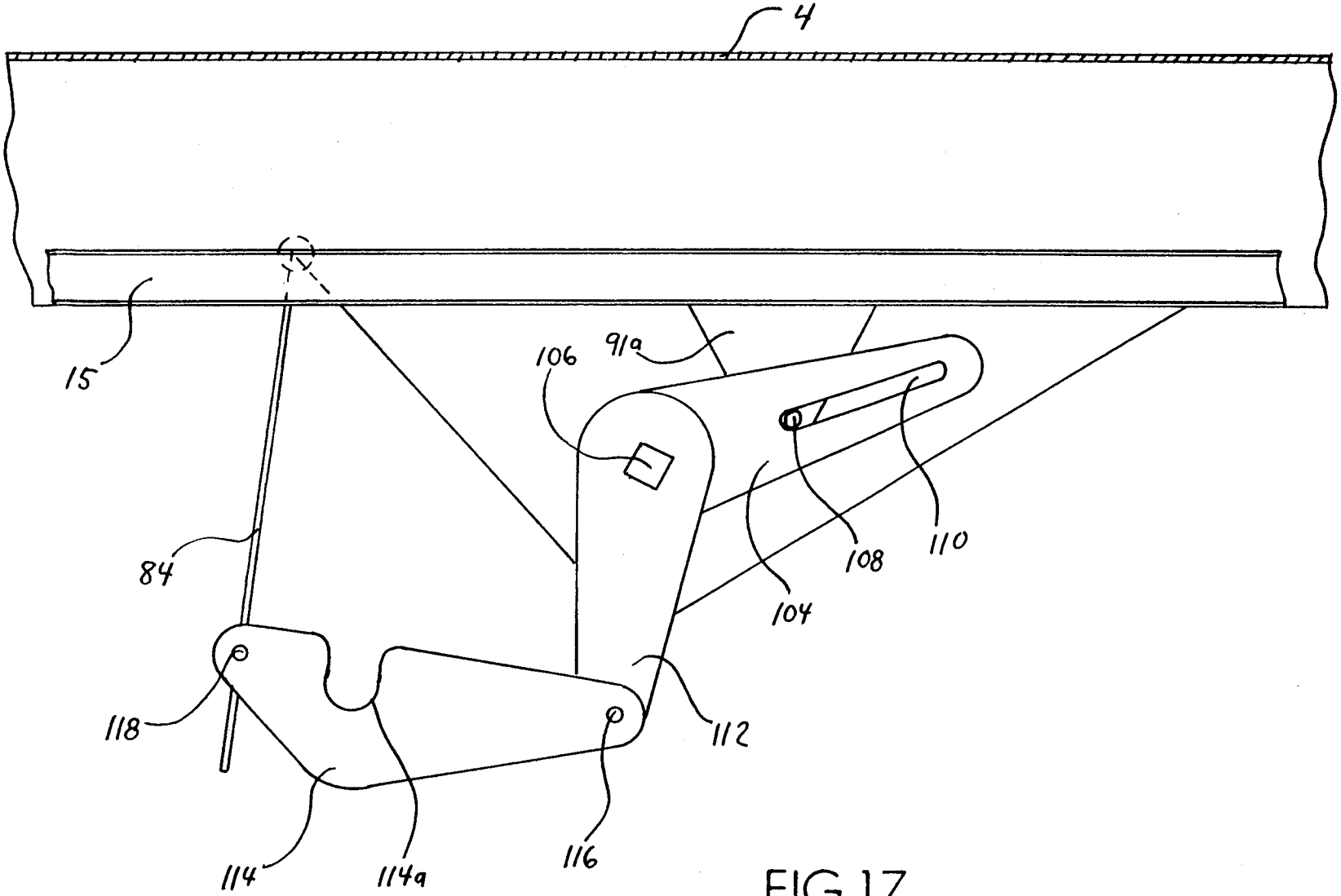
FIG. 17 is an elevational view, partly in cross-section, of the pocket shown in FIG. 15, in its open position.

The operation of the reverse hopper mechanism is similar. As beam 15 moves in direction A, drive pin 108 of actuating member 91*a* moves along in a straight line in slot 110, causing lever 104 to rotate. As lever 104, and consequently lever 112, rotates, pin 116 also rotates, causing lever 114 to pivot about pin 118. Finally, as the center line between pins 116 and 118 passes through the center of shaft 88, the over center latch is released allowing door 84 to open. FIGS. 16 and 17 show the respective hoppers in the open position.

The closing of the hopper doors is accomplished by reversing the direction of actuating beam 15, causing the mechanism to operate in the reverse manner as has been described previously. It can be seen that the system creates an over center latch for each door, adding a positive safety to the system.

While the invention has been shown and described in terms of several embodiments, it will be understood that this invention is not limited to these particular embodiments and that many changes and modifications may be made without departing from the true spirit and scope of the invention as defined in the appended claims.

What is claimed is:

1. A hopper car comprising:

a car body having an underside;

at least one row of discharge chutes located along the underside of said body and aligned along the longitudinal axis of said hopper car;

a plurality of rotatable doors for closing said discharge chutes;

shifting means, shiftable in a linear direction along the longitudinal axis of said hopper car, for shifting said doors between a first position fully closing said discharge chutes and a second position fully opening said discharge chutes, said shifting means consisting of a slidable actuating beam attached to the underside of said body, an extension downwardly depending from said actuating beam and corresponding to each discharge chute, and a drive pin rigidly affixed to said extension;

a single activating means, operative in a linear direction, connected to said shifting means for shifting said doors from said first position to said second position; and a plurality of driving systems, with each system only operative upon the doors of a single discharge chute, each driving system consisting of at least one first drive lever having a slot for slidably receiving said drive pin, a single rotatable drive shaft rigidly affixed to said at least one first drive lever, at least one second drive lever rigidly affixed to said drive shaft, and at least one third drive lever rotatably affixed at one end of said at least one second drive lever and rotatably affixed at other end to one of said doors, for coupling said shifting means to said one of said doors.

2. The hopper car of claim 1, further comprising a center frame member extending longitudinally along said underside of said body for supporting said shifting means and said activating means.

3. The car of claim 2, wherein said activating means comprises an air cylinder rigidly affixed to said center frame member, which cylinder is coupled to said shifting means.

4. The car of claim 1, wherein each said driving system applies tension force to one of said doors in order to pull said door from said open position to said close position.

5. The car of claim 1, wherein each said driving system operates as an over-center latch to aid in the closing of one of said doors.

6. The car of claim 1, wherein the total surface area of said discharge chutes that is exposed when said doors are in said second position is greater than 100 square feet.

7. The car of claim 1, wherein the number of discharge chutes is twelve, and the total surface area of said discharge chutes that is exposed when said doors are in said second position is greater than 180 square feet.

8. A mechanism for actuating doors of a hopper car including a body having an underside, at least one row of discharge chutes along the underside of the body and aligned along the longitudinal axis of the car, and said doors being a plurality of rotatable doors for closing the discharge chutes; said mechanism comprising:

means for shifting said doors between a first position closing said discharge chutes and a second position opening said discharge chutes, said shifting means consisting of an actuating beam slidably attached to the underside of said body. an extension downwardly depending from said actuating beam and corresponding to each discharge chute, and a drive pin rigidly affixed to said extension;

a single activating means, operative in a linear direction, connected to said shifting means for shifting said doors from said first position to said second position;

a drive system, associated with each said discharge chute and only operative upon the doors closing its respective chute, consisting of first drive lever means having a slot for slidably receiving said drive pin, second drive lever means, a rotatable drive shaft upon which said first and second lever means are affixed, and third drive lever means rotatably coupled at one end to said second drive lever means and at its other end to one of said doors.

9. The mechanism of claim 8, further comprising a center frame member extending longitudinally along the underside of said body for supporting said shifting means and said activating means.

10. The mechanism of claim 9, wherein said third drive lever means includes pins for rotatably coupling to said second drive lever means and one of said doors.

11. The mechanism of claim 10, whereby when said one of said doors moves from said second position to said first position, the movement of a plane, which extends through said pins, past the center line of said drive shaft creates an over center latching action to positively close one of said doors.

12. The mechanism of claim 8, whereby each of said discharge chutes is closed by a pair of doors.

13. The mechanism of claim 8, whereby each of said discharge chutes is closed by a single door.

14. An operating system for activating doors of a railroad hopper car including a body having an underside, at least one longitudinal row of discharge chutes along the underside of the body, and said doors being a plurality of doors coupled for rotation to the body to close said discharge chutes, said system comprising:

means for shifting the doors between a first chute close position and a second chute open position, said shifting means consisting of an actuating beam slidably attached to the underside of said body, an extension downwardly depending from said actuating beam and corresponding to each discharge chute, and a drive pin rigidly affixed to said extension;

drive means operative only upon the door associated with a single respective discharge chute in said row, said drive means consisting of a first drive lever containing a slot for slidably receiving said drive pin, a second drive lever, a rotatable drive shaft upon which said first and second drive levers are rigidly affixed, and a third drive lever rotatably coupled at one end to said second drive lever and rotatably coupled at its other end to one of the doors, for coupling said shifting means to said one of the doors;

and activating means connected to said shifting means for automatically shifting the doors from said first chute close position to said second chute open position.

15. The system of claim 14, further comprising a center frame member extending longitudinally along said underside of said body for supporting said shifting means and said activating means.

16. The system of claim 14 wherein said drive means applies tension force to one of said doors in order to pull said door from said second chute open position to said first chute close position.

17. The system of claim 14, wherein said drive means operates as an over-center latch to aid in the closing of one of said doors.

* * * * *